US009303857B2

(12) United States Patent
Desilva et al.

(10) Patent No.: US 9,303,857 B2
(45) Date of Patent: Apr. 5, 2016

(54) LED LAMP WITH OMNIDIRECTIONAL LIGHT DISTRIBUTION

(71) Applicant: Cree, Inc., Durham, NC (US)

(72) Inventors: Nicholas Desilva, Four Oaks, NC (US); Dante Nava, Cary, NC (US); Robert Higley, Cary, NC (US); Mark Youmans, Goleta, CA (US)

(73) Assignee: Cree, Inc., Durham, NC (US)

( * ) Notice: Subject to any disclaimer, the term of this patent is extended or adjusted under 35 U.S.C. 154(b) by 16 days.

(21) Appl. No.: 13/793,325

(22) Filed: Mar. 11, 2013

(65) Prior Publication Data

US 2014/0218931 A1 Aug. 7, 2014

Related U.S. Application Data

(60) Provisional application No. 61/760,419, filed on Feb. 4, 2013.

(51) Int. Cl.

| | |
|---|---|
| ***F21V 1/00*** | (2006.01) |
| ***F21V 29/00*** | (2015.01) |
| ***F21K 99/00*** | (2010.01) |
| ***F21V 17/16*** | (2006.01) |
| ***F21V 29/77*** | (2015.01) |

(Continued)

(52) U.S. Cl.

CPC ..... *F21V 29/22* (2013.01); *F21K 9/135* (2013.01); *F21V 3/02* (2013.01); *F21V 17/164* (2013.01); *F21V 29/773* (2015.01); *F21Y 2101/02* (2013.01); *F21Y 2103/022* (2013.01)

(58) Field of Classification Search

CPC ..... F21K 9/175; F21K 9/00; F21V 29/2206; F21V 29/2268; F21V 29/74; F21V 29/745; F21V 29/75; F21V 29/76; F21V 29/763; F21V 29/767; F21V 29/773; F21V 29/777; F21S 48/1159

USPC ..... 362/23.07, 23.1, 23.17, 23.09, 249.06, 362/249.14, 275, 311.02, 311.13, 294, 362/249.02

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

OTHER PUBLICATIONS

U.S. Appl. No. 13/649,052, filed Oct. 10, 2012.

(Continued)

*Primary Examiner* — Evan Dzierzynski
*Assistant Examiner* — Matthew Peerce
(74) *Attorney, Agent, or Firm* — Dennis J. Williamson; Moore & Van Allen PLLC

(57) ABSTRACT

An LED based lamp has an optically transmissive enclosure connected to a base. The base may include a heat sink. A substrate is positioned in the enclosure and supports a plurality of LEDs where the periphery of the substrate has alternating recessed portions and protruding portions that define a plurality of laterally extending projections. One LED is located on each of the projections to increase the amount of down light generated by the lamp.

18 Claims, 11 Drawing Sheets

(51) Int. Cl.

| | |
|---|---|
| ***F21V 3/02*** | (2006.01) |
| *F21Y 101/02* | (2006.01) |
| *F21Y 103/02* | (2006.01) |

(56) References Cited

U.S. PATENT DOCUMENTS

| | | | | |
|---|---|---|---|---|
| 5,561,346 | A | 10/1996 | Byrne | |
| 5,577,831 | A * | 11/1996 | Chang | 362/240 |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,465,961 | B1 | 10/2002 | Cao | |
| 6,523,978 | B1 * | 2/2003 | Huang | 362/249.04 |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 * | 3/2004 | Ishibashi | 362/235 |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 * | 8/2006 | Maxik | 362/249.04 |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 7,965,023 | B1 | 6/2011 | Liang | |
| 8,021,025 | B2 | 9/2011 | Lee | |
| 8,047,686 | B2 * | 11/2011 | Dahm et al. | 362/294 |
| 8,109,660 | B2 * | 2/2012 | Hochstein et al. | 362/373 |
| 8,123,382 | B2 * | 2/2012 | Patrick et al. | 362/294 |
| 8,172,422 | B2 * | 5/2012 | Kim | 362/234 |
| 8,227,968 | B2 * | 7/2012 | Kaandorp | F21K 9/135 313/114 |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,230 | B2 * | 10/2012 | Stewart et al. | 362/101 |
| 8,282,249 | B2 | 10/2012 | Liang et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 * | 2/2013 | Carroll | 362/311.02 |
| 8,400,051 | B2 | 3/2013 | Hakata et al. | |
| 8,414,160 | B2 * | 4/2013 | Sun et al. | 362/294 |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,427,037 | B2 | 4/2013 | Liang et al. | |
| 8,434,900 | B2 * | 5/2013 | Yang | 362/249.03 |
| 8,449,154 | B2 | 5/2013 | Uemoto et al. | |
| 8,461,748 | B1 * | 6/2013 | Taj | 313/46 |
| 8,502,468 | B2 | 8/2013 | Li et al. | |
| 8,556,462 | B2 * | 10/2013 | Huang | 362/249.02 |
| 8,556,465 | B2 | 10/2013 | Lee et al. | |
| 8,641,237 | B2 | 2/2014 | Chuang | |
| 8,646,942 | B2 * | 2/2014 | Boomgaarden et al. | 362/249.02 |
| 8,653,723 | B2 | 2/2014 | Cao et al. | |
| 8,680,754 | B2 * | 3/2014 | Premysler | 313/46 |
| 8,696,168 | B2 * | 4/2014 | Li et al. | 362/294 |
| 8,696,170 | B2 * | 4/2014 | Huang | 362/294 |
| 8,696,176 | B2 * | 4/2014 | Davey et al. | 362/373 |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2004/0022057 | A1 * | 2/2004 | Lee | 362/238 |
| 2004/0201990 | A1 | 10/2004 | Meyer | |
| 2005/0174769 | A1 * | 8/2005 | Yong et al. | 362/235 |
| 2006/0164835 | A1 * | 7/2006 | Sidwell et al. | 362/249 |
| 2007/0170448 | A1 * | 7/2007 | Ito et al. | 257/98 |
| 2009/0059594 | A1 * | 3/2009 | Lin | 362/294 |
| 2009/0168418 | A1 * | 7/2009 | Zheng et al. | 362/234 |
| 2009/0184618 | A1 | 7/2009 | Hakata et al. | |
| 2009/0244896 | A1 * | 10/2009 | McGehee et al. | 362/249.02 |
| 2011/0175545 | A1 * | 7/2011 | Harris | 315/294 |
| 2011/0228516 | A1 * | 9/2011 | Stewart et al. | 362/84 |
| 2011/0298350 | A1 | 12/2011 | Van De Ven | |
| 2012/0040585 | A1 | 2/2012 | Huang | |
| 2012/0243230 | A1 * | 9/2012 | Carroll et al. | 362/249.02 |
| 2012/0287637 | A1 * | 11/2012 | Mahalingam et al. | 362/249.02 |
| 2012/0300455 | A1 * | 11/2012 | Breidenassel et al. | 362/235 |
| 2012/0307498 | A1 * | 12/2012 | Lo et al. | 362/249.02 |
| 2013/0027938 | A1 * | 1/2013 | Hisayasu | 362/249.02 |
| 2013/0051003 | A1 * | 2/2013 | Fan | 362/231 |
| 2013/0058080 | A1 * | 3/2013 | Ge et al. | 362/231 |
| 2013/0077298 | A1 * | 3/2013 | Steele et al. | 362/230 |
| 2013/0170175 | A1 * | 7/2013 | Negley et al. | 362/84 |
| 2013/0301268 | A1 * | 11/2013 | Johnston et al. | 362/249.02 |
| 2014/0043815 | A1 * | 2/2014 | Chuang | 362/249.02 |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

OTHER PUBLICATIONS

U.S. Appl. No. 13/649,067, filed Oct. 10, 2012.

Energy Star® Program Requirements for Integral LED Lamps, Mar. 22, 2010, pp. 1-30.

* cited by examiner

OMNIDIRECTIONAL LAMP IN BASE-UP POSITION

LED LAMP WITH OMNIDIRECTIONAL LIGHT DISTRIBUTION

This application claims benefit of priority under 35 U.S.C. §119(e) to the filing date of U.S. Provisional Application No. 61/760,419, as filed on Feb. 4, 2013, which is incorporated herein by reference in its entirety.

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a luminaire, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. Since, ideally, an LED lamp designed as a replacement for a traditional incandescent or fluorescent light source needs to be self-contained; a power supply may be included in the lamp structure along with the LEDs or LED packages and the optical components. A heatsink is also often needed to cool the LEDs and/or power supply in order to maintain appropriate operating temperature.

SUMMARY OF THE INVENTION

In some embodiments, an LED based lamp comprises an optically transmissive enclosure and a base connected to the enclosure. A substrate supports a plurality of LEDs in the enclosure where the periphery of the substrate has alternating recessed portions and protruding portions that define a plurality of laterally extending projections. One of the plurality of LEDs is supported on one of the plurality of projections.

The base may comprise an Edison connector. The substrate may be thermally coupled to a heat sink such that heat from the LEDs is transferred to the exterior of the bulb. The plurality of LEDs may be disposed about the periphery of the enclosure adjacent to the base and may be positioned to direct light primarily away from base. Each one of the plurality of projections may support one of the plurality of LEDs. The plurality of LEDs may be mounted at the distal ends of the plurality of projections such that backlight generated by the plurality of LEDs may project toward the base of the lamp around a major portion of each of the plurality of LEDs. The projections may be dimensioned such that each of the plurality of LEDs is closely disposed to the edge of the projection along at least two sides of each of the plurality of LEDs. The heat sink may be provided with protruding portions and recessed portions that correspond to the protruding portions and recessed portions on the periphery of the substrate. The recessed portions and protruding portions of the substrate may be in a one-to-one relationship with the recessed portions and protruding portions of the heat sink. The recessed portions and protruding portions of the heat sink may extend along the length of the heat sink such that longitudinally extending passages are formed from the LEDs toward the base. The enclosure may extend over the substrate and the plurality of LEDs and may be connected to the heat sink. The enclosure may be provided with a plurality of tabs that extend into mating apertures on the heat sink. An open neck of the enclosure may receive the heat sink and may be provided with a periphery that is a mirror image of the outer surface of the heat sink. Selected ones of the plurality of LEDs may be mounted on the substrate such that the selected ones of the plurality of LEDs are disposed at an angle other than 90 degrees relative to the longitudinal axis of the lamp to direct more light as downlight. A mounting surface on the substrate for mounting the selected ones of the plurality of LEDs may be disposed at an angle other than 90 degrees relative to the longitudinal axis of the lamp. The selected ones of the plurality of LEDs may be mounted using a bendable substrate such that the projections are bent relative to the substrate to position the selected ones of the plurality of LEDs at the angle. The protruding portions of the heat sink may extend through the enclosure.

In some embodiments, an LED based lamp comprises an optically transmissive enclosure and a base connected to the enclosure. A substrate supports a plurality of LEDs in the enclosure where the periphery of the substrate comprises a plurality of laterally extending projections where one of the plurality of LEDs is supported on one of the plurality of projections such that a side of each of the plurality of projections is closely adjacent each of the plurality of LEDs over at least 180 degrees.

DETAILED DESCRIPTION

Figure 3:
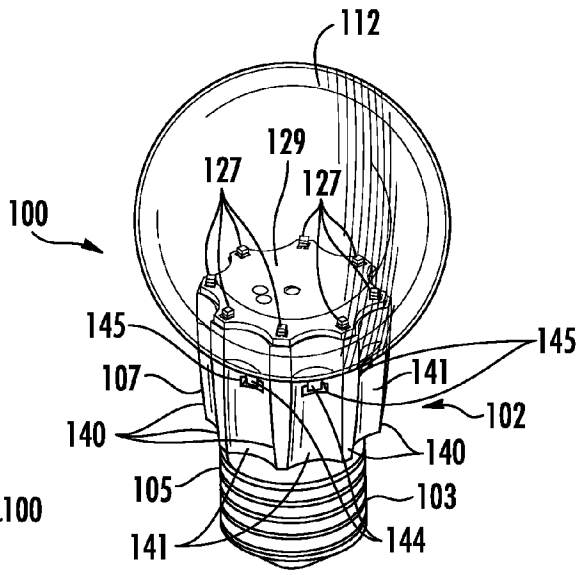
FIG. 3 is a perspective view of the lamp of claim 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 1:
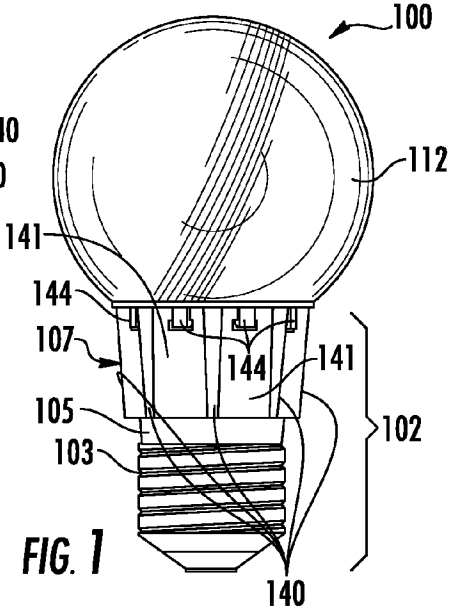
FIG. 1 is a plan view of an embodiment of a lamp of the invention.
Figure 2:
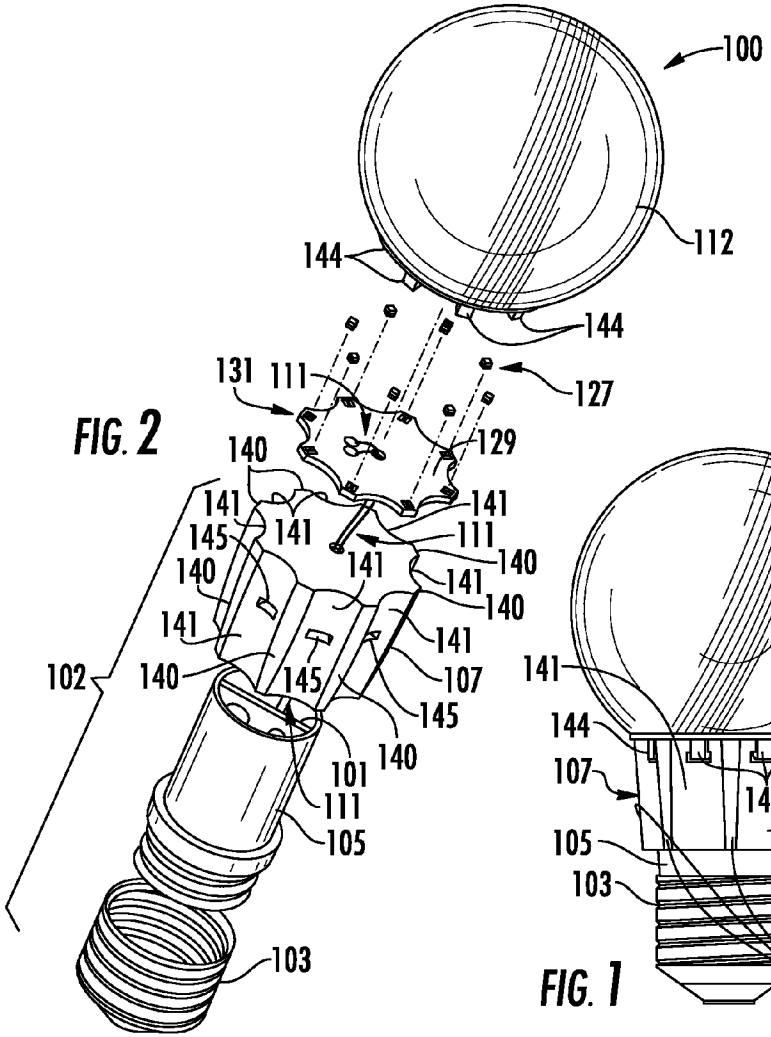
FIG. 2 is an exploded perspective view of a lamp of FIG. 1.
Figure 5:
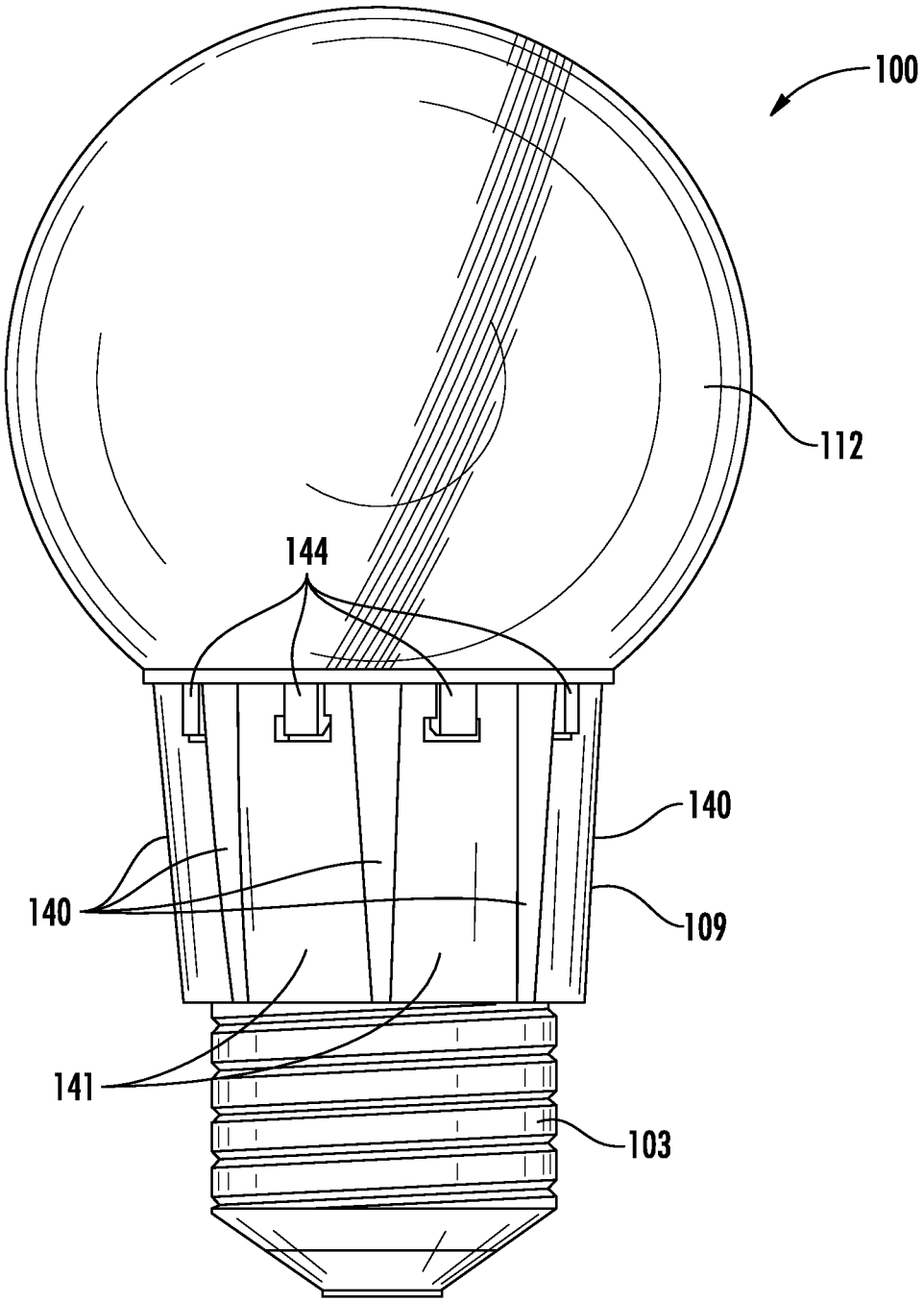
FIG. 5 is a plan view of another embodiment of a lamp of the invention.

FIGS. 1 through 3 show a lamp, 100, according to some embodiments of the present invention. Lamp 100 comprises a base 102 connected to an optically transmissive enclosure 112. Lamp 100 may be used as an A-series lamp with an Edison base, more particularly; lamp 100 may be designed to serve as a solid-state replacement for an A19 incandescent bulb. The Edison base as shown and described herein may be implemented through the use of an Edison connector 103 and a plastic or metal form 105 that is connected to a heat sink structure 107 (FIG. 1) or the Edison connector 103 may be connected to a heat sink structure 109 without an intervening form 105 (FIG. 5). LEDs 127 are mounted on substrate 129 and are operable to emit light when energized through an electrical connection. The substrate 129 supports the individual LEDs or LED packages (hereinafter "LEDs") and in one embodiment comprises a PCB although the substrate may comprise other structures. In some embodiments, electrical circuitry may be provided on the substrate for powering the LEDs 127. While a lamp having the size and form factor of a standard-sized household incandescent bulb is shown, the lamp may have other the sizes and form factors.

Enclosure 112 is, in some embodiments, made of glass, quartz, borosilicate, silicate, polycarbonate, other plastic or other suitable material. The enclosure 112 may be of similar shape to that commonly used in household incandescent bulbs. It should also be noted that the enclosure 112 or a portion of the enclosure could be coated or impregnated with phosphor. The enclosure 112 may be transparent or translucent such that the light emitted into the interior of the enclosure, passes through the enclosure and is emitted from the enclosure. In some embodiments, the enclosure 112 may have a diffuser layer that scatters the light passing through the enclosure to produce a broad beam intensity profile. The diffuser layer may be transparent, semi-transparent, or translucent. In one embodiment, a uniform diffuser layer may be applied to the entire surface of the enclosure 112. In some embodiments, the enclosure 112 is coated on the inside with silica, alumina, titanium dioxide, or other particulate to provide a diffuser scattering layer that produces a more uniform far field pattern. The enclosure 112 may also be etched, frosted or coated. The enclosure may also have the diffuser layer formed as a part of the enclosure rather than applied to the enclosure. For example, the enclosure 112 may be made of a material such as acrylic or borosilicate glass where the enclosure material has light scattering properties.

Lamp base 102 includes a connector, such as Edison connector 103, that functions as the electrical connector to connect the lamp 100 to an electrical socket or other power source. Depending on the embodiment, other base configurations are possible to make the electrical connection such as other standard bases or non-traditional bases. Base 102 may include the electronics 101 for powering lamp and may include a power supply and/or driver and form all or a portion of the electrical path between the mains and the LEDs. Base 102 may also include only part of the power supply circuitry while some components reside on the substrate 129. Electrical conductors 111 run between the substrate 129 and the lamp base 102 to carry both sides of the supply to provide critical current to the LEDs 127.

The lamp 100 comprises a solid-state lamp comprising a plurality of LEDs 127. The LEDs 127 are mounted in the lamp on a substrate 129 where the substrate typically supports a plurality of LEDs 127. The substrate 129 provides the physical support for the LEDs 127 and properly positions the LEDs in the enclosure 112. The substrate may also provide an electrical path to the LEDs 127 from the conductors 111. In some embodiments low voltage LEDs may be used. In other embodiments, high voltage LEDs may be used using boost voltage converter technology to improve efficiency of the lamp 100.

The substrate 129 and LEDs 127 are arranged such that the LEDs 127 are disposed about the periphery of the enclosure 112 adjacent to the bottom of the enclosure 112 and are positioned to direct light primarily upwardly, away from base 102. The substrate 129 may be in thermal and electrical connection with the base 102 such that an electrical connection is established between the base and the LEDs 127 mounted on the substrate 129. The LEDs 127 may be evenly spaced about the periphery of the enclosure 112 such that the light projected from each of the LEDs 127 projects over an equal area of the enclosure 112. For example, in the illustrated embodiment eight LEDs 127 are provided where each LED is disposed approximately 45 degrees from the adjacent LED such that each LED covers an equal portion of enclosure 112. The LEDs 127 are arranged such that the light emitted from each LED overlaps with the light emitted from the other LEDs. As a result, while each LED is arranged to project light over a portion of the bulb the light from the LEDs overlaps to a large degree. While a lamp with eight LEDs is shown, a greater or fewer number of LEDs may be used.

The substrate 129 may be made of a thermally conductive material such that heat generated by the LEDs 127 is transferred to the heat sink 107 (FIGS. 1-3), 109 (FIG. 5) and to the exterior of the enclosure 112 via the substrate. Substrate 129 may be thermally coupled to a heat sink 107, 109 such that heat from the LEDs 127 is efficiently transferred to the exterior of the bulb. The heat sink 107, 109 may be secured to the Edison connector 103 or to intermediate housing portion 105. The Edison screw 103 may be connected to the housing portion 105 and/or heat sink 109 by adhesive, mechanical connector, welding, separate fasteners or the like. The housing portion 105 may be made of a thermally conductive material such as metal or ceramic to form a part of the heat sink structure. Further, the housing portion 105 may also comprise an electrically insulating material such as plastic. Because the LEDs 127 may be attached directly to the substrate 129 and the substrate is thermally coupled to the heat sink structure 107, 109, heat is transferred from the LEDs to the exterior of the bulb over a short thermal path. In some embodiments, a reflective coating, surface, layer and/or element may be provided on the mounting surface of the substrate 129 and the exterior surface of the heat sink and housing portion to better reflect light. The surfaces may be specular such as polished surfaces or may be white.

In one embodiment, the enclosure 112 and base 102 are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. In some embodiments, the LED lamp 100 may be equivalent to standard watt incandescent light bulbs.

The Edison screw 103 and the heat sink and/or housing portion 105 define an internal cavity for receiving the electronics 101 of the lamp including the power supply and/or drivers or a portion of the electronics for the lamp. The lamp electronics 101 are electrically coupled to the Edison screw 103 such that the electrical connection may be made from the Edison screw 103 to the lamp electronics 101. The Edison screw 103, heat sink 107, 109 and/or base 102 may be potted to physically and electrically isolate and protect the lamp electronics 101.

With respect to the features described above with various example embodiments of a lamp, the features can be combined in various ways. The LEDs 127 may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in as described herein. The LEDs 127 are operable to emit light when energized through an electrical connection. The LEDs 127 may comprise an LED die disposed in an encapsulant such as silicone, and LEDs which are encapsulated with a phosphor to provide local wavelength conversion, as will be described later when various options for creating white light are discussed. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used with the appropriate phosphor. LED devices can be used with phosphorized coatings packaged locally with the LEDs or with a phosphor coating the LED die as previously described. For example, blue-shifted yellow (BSY) LED devices, which typically include a local phosphor, can be used with a red phosphor to create substantially white light, or combined with red emitting LED devices in the array to create substantially white light. A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference.

In one embodiment of the invention LEDs that emit a significant amount of backlight may be advantageously used. Backlight is light emitted by the LED that is directed toward the base of the LED chip or LED package. One such LED component is sold by CREE, Inc. as the XQD LED. CREE XQD LEDs are described in U.S. patent application Ser. No. 13/649,052 filed on Oct. 10, 2012 which is incorporated by reference herein in its entirety, and U.S. patent application Ser. No. 13/649,067 filed on Oct. 10, 2012 which is incorporated by reference herein in its entirety. Other LEDs that provided significant backlight may also be used.

Figure 6:
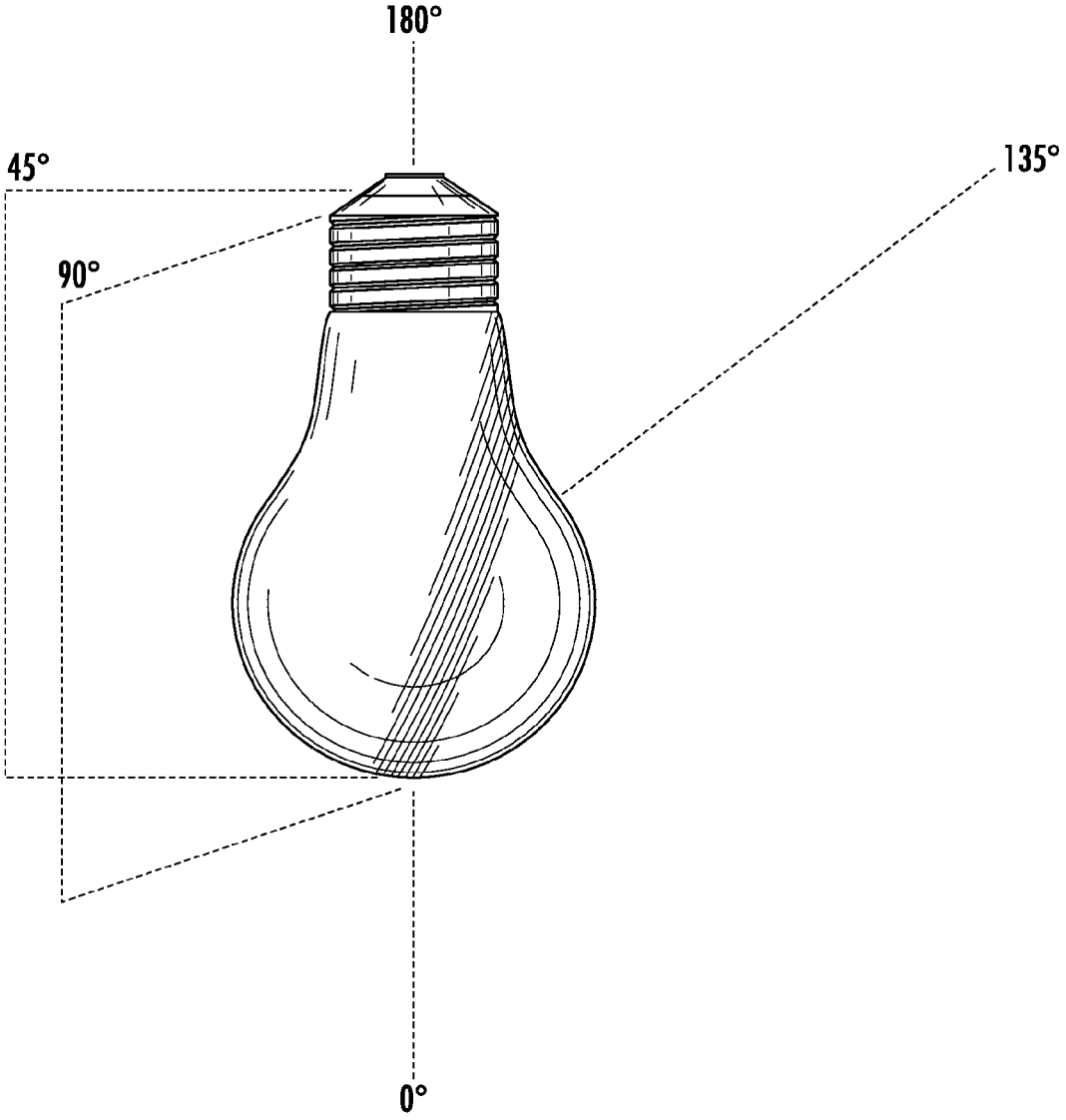
FIG. 6 is a diagram taken from the "ENERGY STAR® Program Requirements for Integral LED Lamps."

While the desired light intensity distribution may comprise any light intensity distribution, in one embodiment the desired light intensity distribution conforms to the ENERGY STAR® Partnership Agreement Requirements for Luminous Intensity Distribution, which is incorporated herein by reference. For an omnidirectional lamp the Luminous Intensity Distribution is defined as "an even distribution of luminous intensity (candelas) within the 0° to 135° zone (vertically axially symmetrical). Luminous intensity at any angle within this zone shall not differ from the mean luminous intensity for the entire 0° to 135° zone by more than 20%. At least 5% of total flux (lumens) must be emitted in the 135°-180° zone. Distribution shall be vertically symmetrical as measures in three vertical planes at 0°, 45°, and 90°." FIG. 6 is a diagram useful in explaining the luminous intensity distribution described above and is "Appendix B: Diagram of Omnidirectional Lamp Zones" taken from the "ENERGY STAR® Program Requirements for Integral LED Lamps" which is incorporated herein by reference. As shown in FIG. 6, the free end of the enclosure 112, opposite to the base, is considered 0° and the base of the lamp is considered 180°. As defined in the standard, luminous intensity is measured from 0° to 135° where the measurements are repeated in vertical planes at 0°, 45° and 90°.

The structure and operation of lamp 100 of the invention is described with specific reference to the ENERGY STAR® standard set forth above; however, the lamp as described herein may be used to create other light intensity distribution patterns. One challenge in providing an LED based lamp that meets the ENERGY STAR® standard is providing sufficient downlight. "Downlight" as used herein means light directed toward the base of the lamp. Because LEDs tend to emit significantly more light toward the top of the LED than as backlight and because solid state lamps tend to use relatively large bases to house the lamp electronics and provide a sufficient heat sink, the base may block some emitted light such that the downlight may be less than as set forth in the ENERGY STAR® standard.

The lamp of the invention provides a system level solution to increase the downlight provided by the lamp to meet the ENERGY STAR® standard. In one embodiment the lamp utilizes LEDs, such as the CREE, Inc. XQ LED, that emit a significant amount of backlight as previously described, although other LEDs may also be used.

Figure 4:
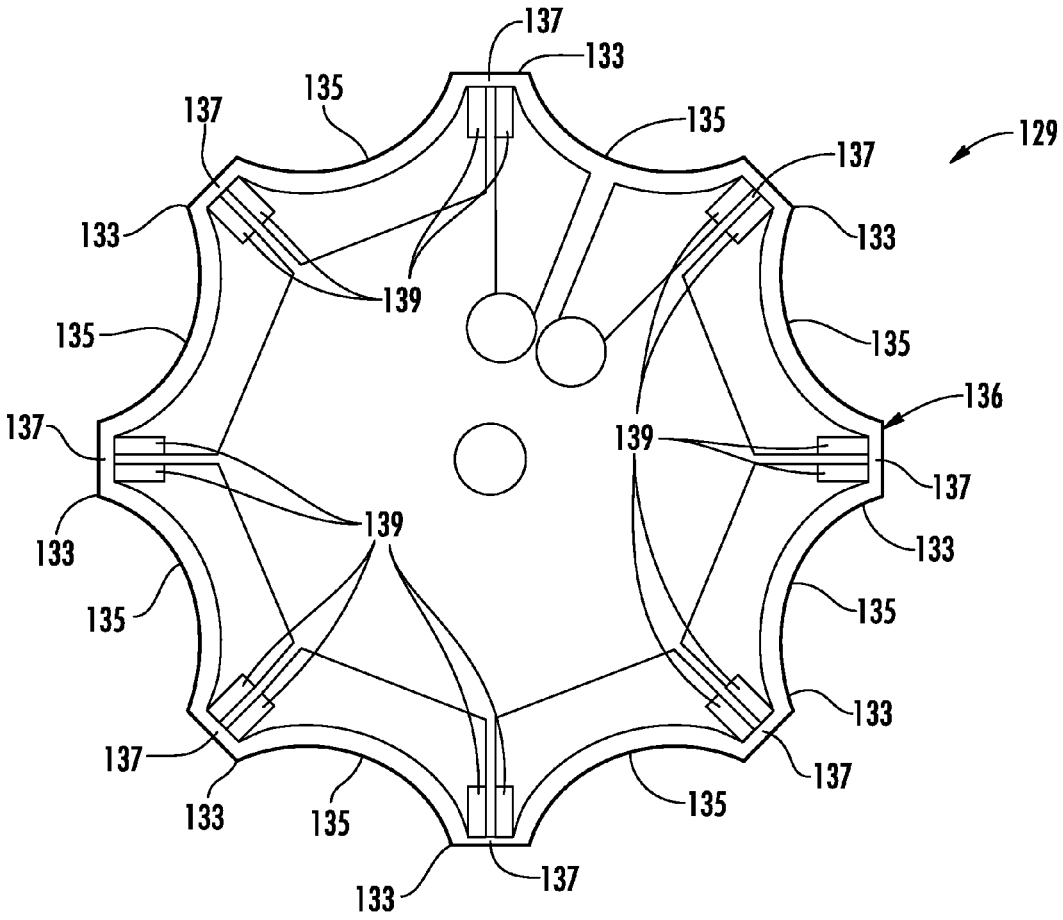
FIG. 4 is a plan view of a substrate and LED assembly used in the embodiment of FIG. 1.
Figure 8:
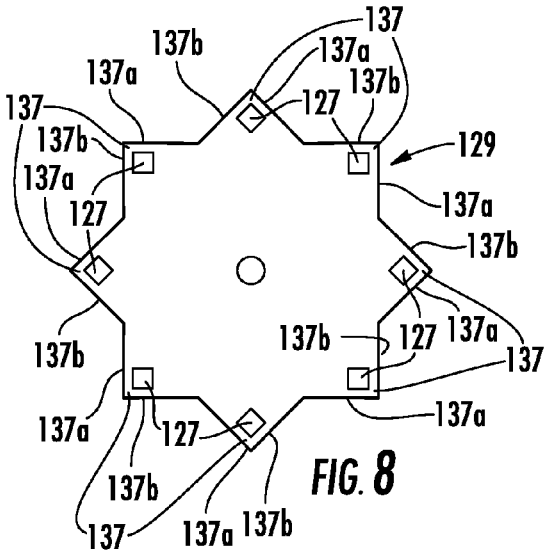
FIGS. 8 through 15 are plan views of alternate embodiments of the substrate and LED assembly used in the embodiment of FIG. 1.
Figure 9:
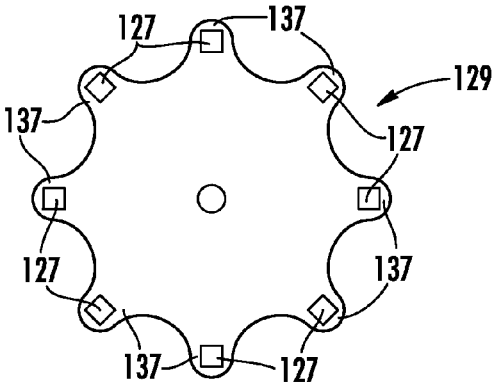
Figure 10:
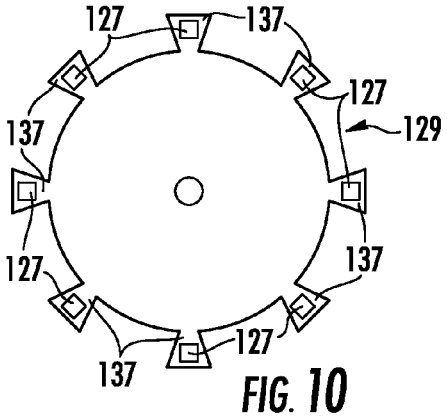
Figure 11:
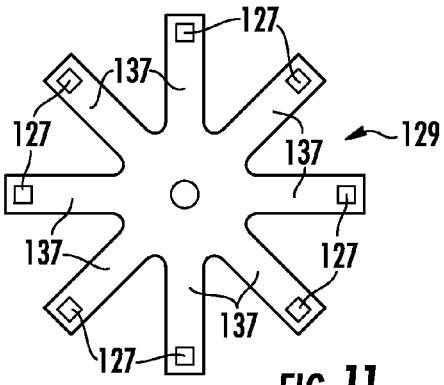
Figure 12:
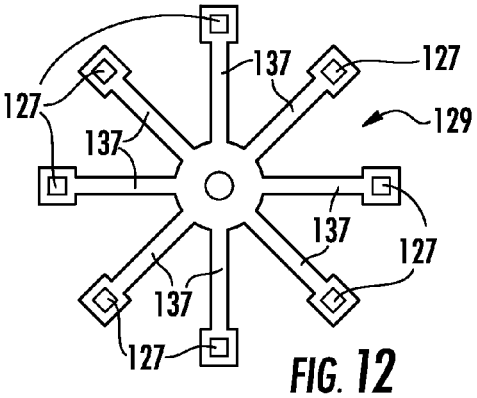
Figure 13:
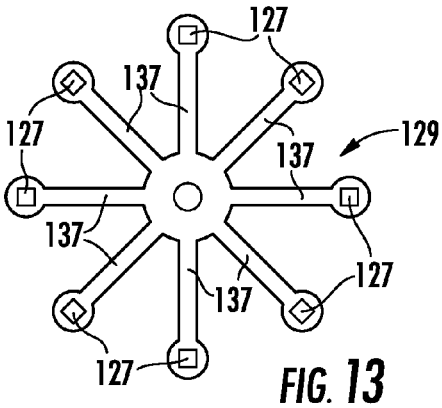
Figure 14:
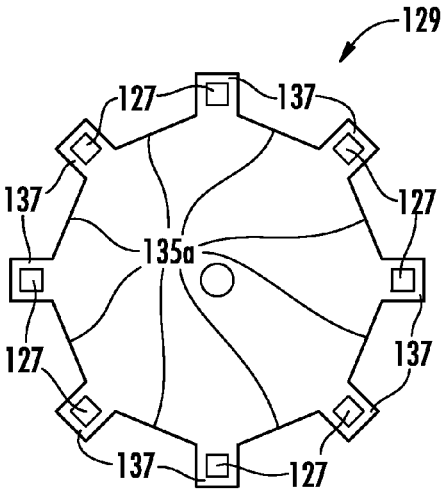
Figure 15:
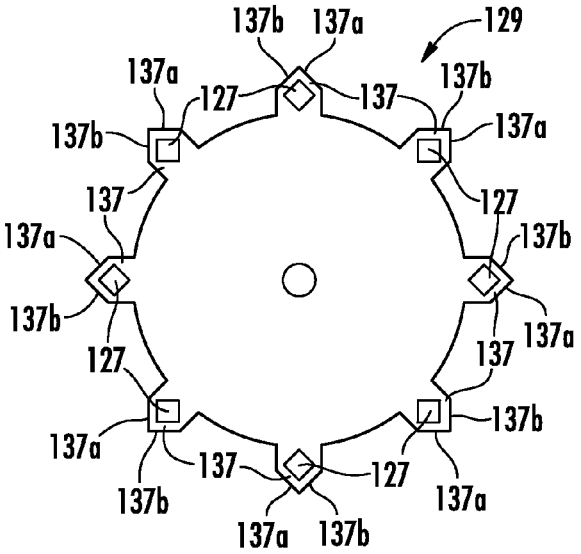

Referring to FIG. 4 for example, the substrate 129 is provided with a notched periphery 131 where protruding portions 133 are alternated with recessed portions 135 to create spaced, laterally extending peninsulas or projections 137 that support the LEDs 127. The LEDs 127 are mounted at the distal ends of the peninsulas or projections 137. In FIG. 4 contact pads 139 are shown on projections 137. The contact pads 139 electrically couple the LEDs 127 to the electrical path. The LEDs 127 are located such that the backlight generated by the LEDs 127 may project toward the base of the lamp around at least two sides of the LEDs. The peninsulas or projections 137 are dimensioned such that the LEDs 127 are closely disposed to the edges of the substrate 129 along at least two sides of the LEDs. As a result, the backlight from the LEDs can project beyond the substrate over a major portion of the LED. In some embodiments, the backlight may project over approximately 180°, over approximately 250°, or approximately 270°, or at a range up to approximately 270°. By forming the substrate 129 as described herein the substrate 129 does not block most of the backlight emitted by the LEDs 127. While a specific shape of the substrate 129 is illustrated the substrate may have other shapes where the alternating recessed portions, protruding portions and projections have different shapes and sizes from those shown in the figures. For example, FIG. 8 shows an LED assembly where the projections 137 are formed with a triangular distal ends where the projections 137 are formed of two sides 137*a* and 137*b* that meet at a corner. FIG. 15 shows a projection 137 having a similarly shaped distal end where the projection extends from the body of the substrate 129 by a short rectangular portion. The LEDs 127 may be oriented such that sides of the LEDs are parallel to or near parallel to the sides 137*a* and 137*b*. FIG. 9 shows an LED assembly where the projections 137 are formed with a continuous curved side. FIG. 10 shows an LED assembly where the projections 137 have a reversed taper where the projections narrow from their distal ends toward the center of the substrate. FIGS. 11 through 13 show LED assemblies where the projections 137 are elongated such that the length of the projections compared to the overall size of substrate 129 is significantly greater than in the previous embodiments. In FIG. 11 the projections 137 have a generally rectangular shape. In FIGS. 12 and 13 the projections 137 have an enlarged distal end that supports the LEDs 127 that is connected to the body of the substrate by a relatively narrow portion. In FIG. 12 the enlarged distal end is rectangular and in FIG. 13 the enlarged distal end is rounded or circular. FIG. 14 shows rectangular projections 137 connected by linear recessed portions 135*a* rather than curved recessed portions. The LED assembly is not limited to the illustrated shapes and other suitable shapes may be used. Further, the various shapes described herein may be combined in a wide variety of configurations.

The heat sink 107, 109 may be provided with protruding portions 140 and recessed portions 141 that correspond to the protruding portions 133 and recessed portions 135 on the periphery of the substrate 129. In one embodiment the recessed portions 135 and protruding portions 133 of the substrate 129 are in a one to one relationship with the recessed portions 141 and protruding portions 140 of the heat sink 107, 109. The profiles of the recessed portions 135 and protruding portions 133 of the substrate 129 may also be the same as the profiles of the recessed portions 141 and protruding portions 140 of the heat sink 107, 109. The recessed portions 141 and protruding portions 140 formed on the exterior of the heat sink 107, 109 extend along the length of the heat sink such that longitudinally extending passages or lightways are formed from the LEDs 127 toward the base of the lamp. These passages direct backlight from the LEDs 127 toward the base of the lamp to increase the amount of downlight that is generated by the lamp. In addition to forming lightways for the backlight the passages also increase the surface area of the heat sink 107, 109 to provide more efficient heat transfer from the LEDs to the ambient environment.

The heat sink 107, 109 and housing portion 105 may also be provided with a tapered profile such that the diameters of these components narrow from the LEDs 127 toward the Edison connector 103 as shown in FIGS. 1 and 5. The narrowing profile provides suitable mechanical and thermal support for the substrate 129 and LEDs 127 while minimizing the amount of light blocked or reflected upwardly by these components.

The enclosure 112 receives the end of the heat sink 107, 109 such that the substrate 129 and LEDs 127 are disposed in the enclosure 112. The open end 147 of the enclosure extends over the substrate 129 and LEDs 127 and is connected to the heat sink 107, 109 at a point below the substrate 129. The enclosure 112 extends to a point between the LEDs 127 and the end of the heat sink near the base end of the lamp to allow light to exit from the enclosure as downlight toward the base end. The enclosure 112 is shaped such that the enclosure allows passage of the backlight out of the lamp toward the base of the lamp. In one embodiment, the enclosure 112 is formed as a globe where the globe extends below and outside of the LEDs 127. In one embodiment the enclosure may be secured to the heat sink by adhesive or mechanical fastener. In the illustrated embodiment the enclosure is provided with a plurality of tabs or fingers 144 that extend into mating apertures or recesses 145 on the heat sink 107, 109. The tabs 144 may be provided with a locking member such that the tabs may be snap-fit into the mating apertures or recesses 145. The open neck 147 of the enclosure 112 may be provided with a notched periphery that is a mirror image of the furrowed outer surface of the heat sink 107, 109 such that the opening in the enclosure 112 closely conforms to the shape of the heat sink to provide a seal between the interior and exterior of the lamp. Adhesive may also be used between the enclosure opening 147 and the heat sink 107, 109 to secure the enclosure to the heat sink and to seal the interior of the lamp.

Figure 7:
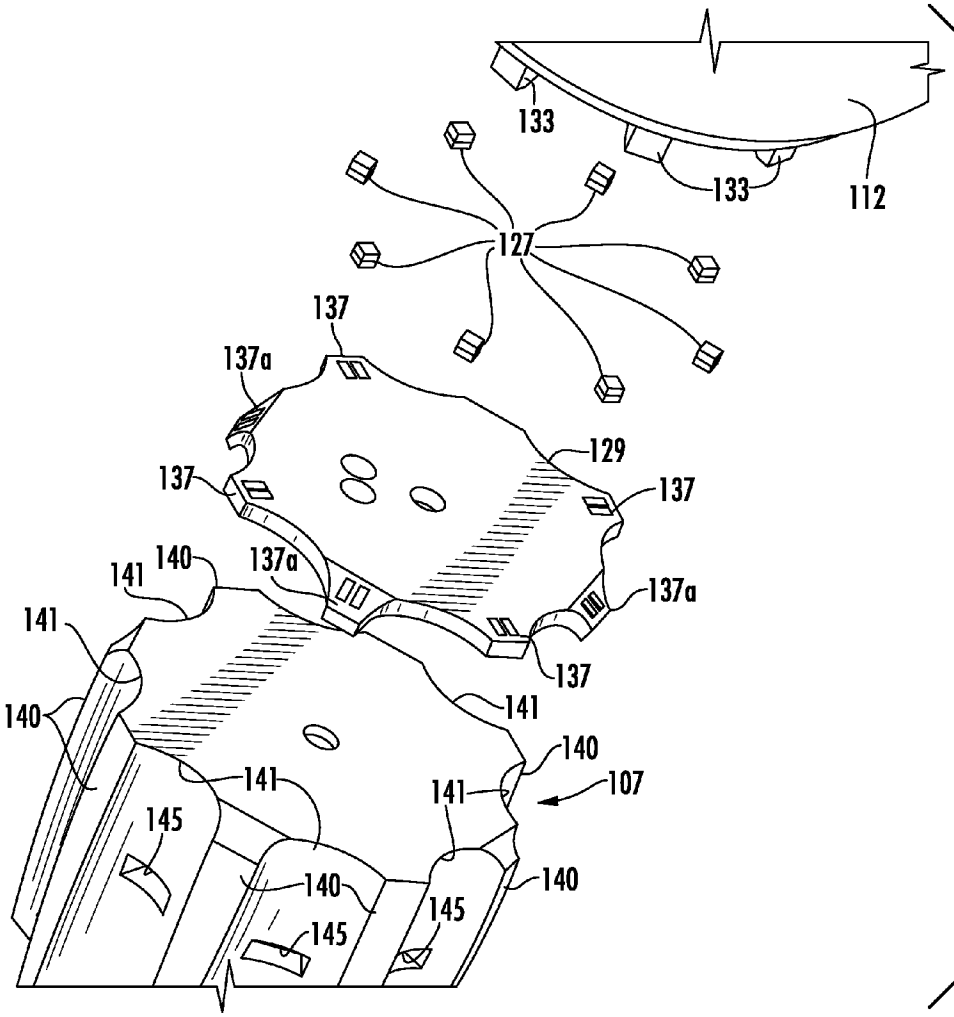
FIG. 7 is a partial exploded perspective view of an alternate embodiment of the lamp of the invention.

In an alternate embodiment, the LEDs may be mounted on the substrate such that the LEDs are disposed at an angle other than 90 degrees relative to the longitudinal axis of the lamp to direct more light as downlight, as shown in FIG. 7. In one embodiment, the LEDs 127 may be mounted at the desired angle by using a bendable substrate such as a metal core printed circuit board (MCPCB) or other similar substrate. The projections or peninsulas 137*a* may be bent downwardly relative to the substrate 129 and the flat projections 137 to angle the LEDs 127 relative to the longitudinal axis of the lamp more toward the base 102 to increase the amount of light directed toward the base. While a bendable substrate has been described the substrate may be rigid but formed to have the projections 137*a* disposed at an angle other than 90 degrees relative to the axis of the lamp. In other embodiments the LEDs may be mounted at an angle on a flat substrate. Further, asymmetrical LEDs may be used to increase the amount of emitted backlight. In some embodiments all of the LEDs may be mounted at an angle while in other embodiments selected ones of the LEDs may be mounted at an angle while other ones of the LEDs are mounted in a flat orientation relative to the substrate.

Figure 16:
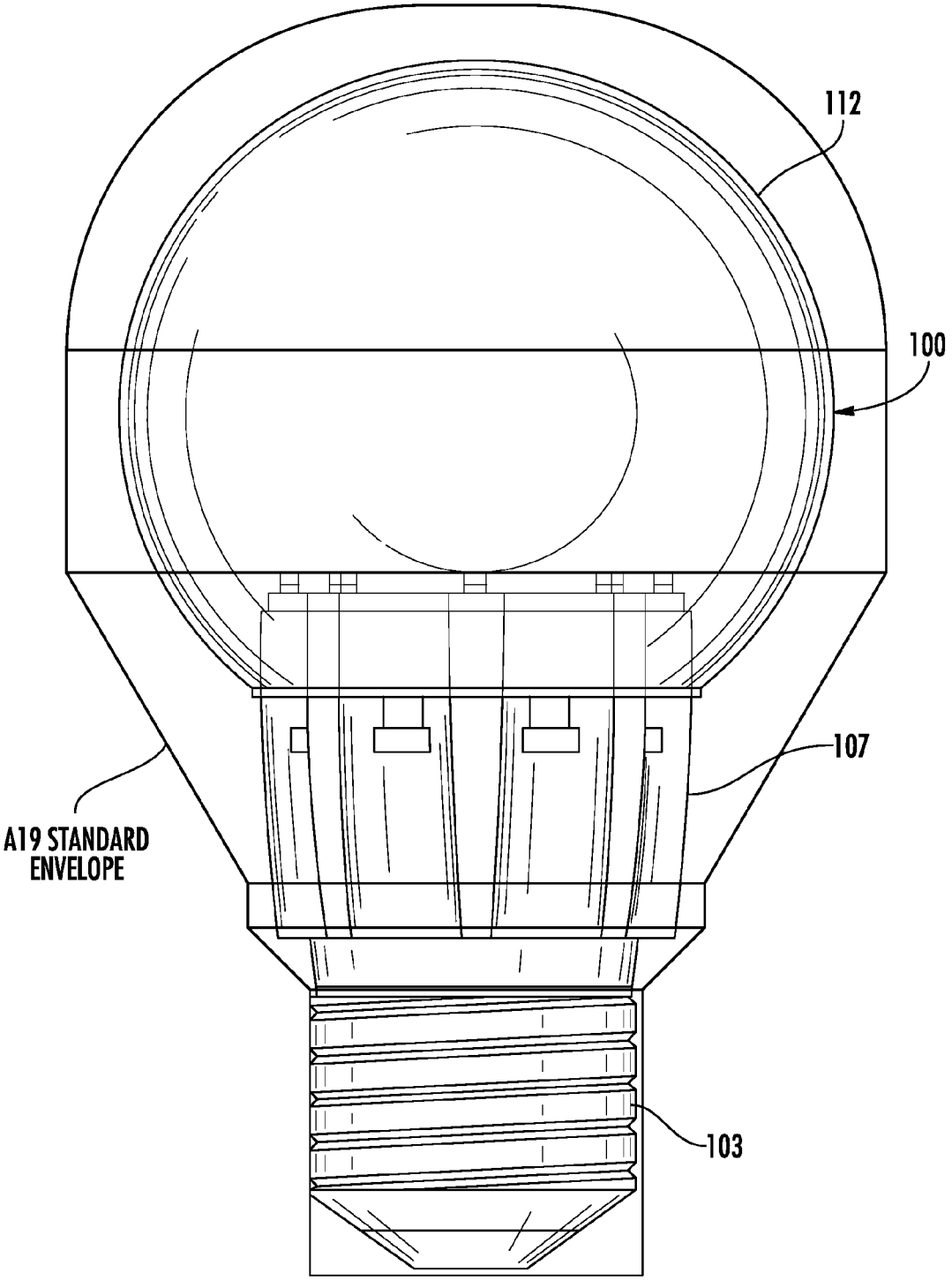
FIG. 16 shows the lamp of FIG. 1 in an A19 standard envelope.
Figure 17:
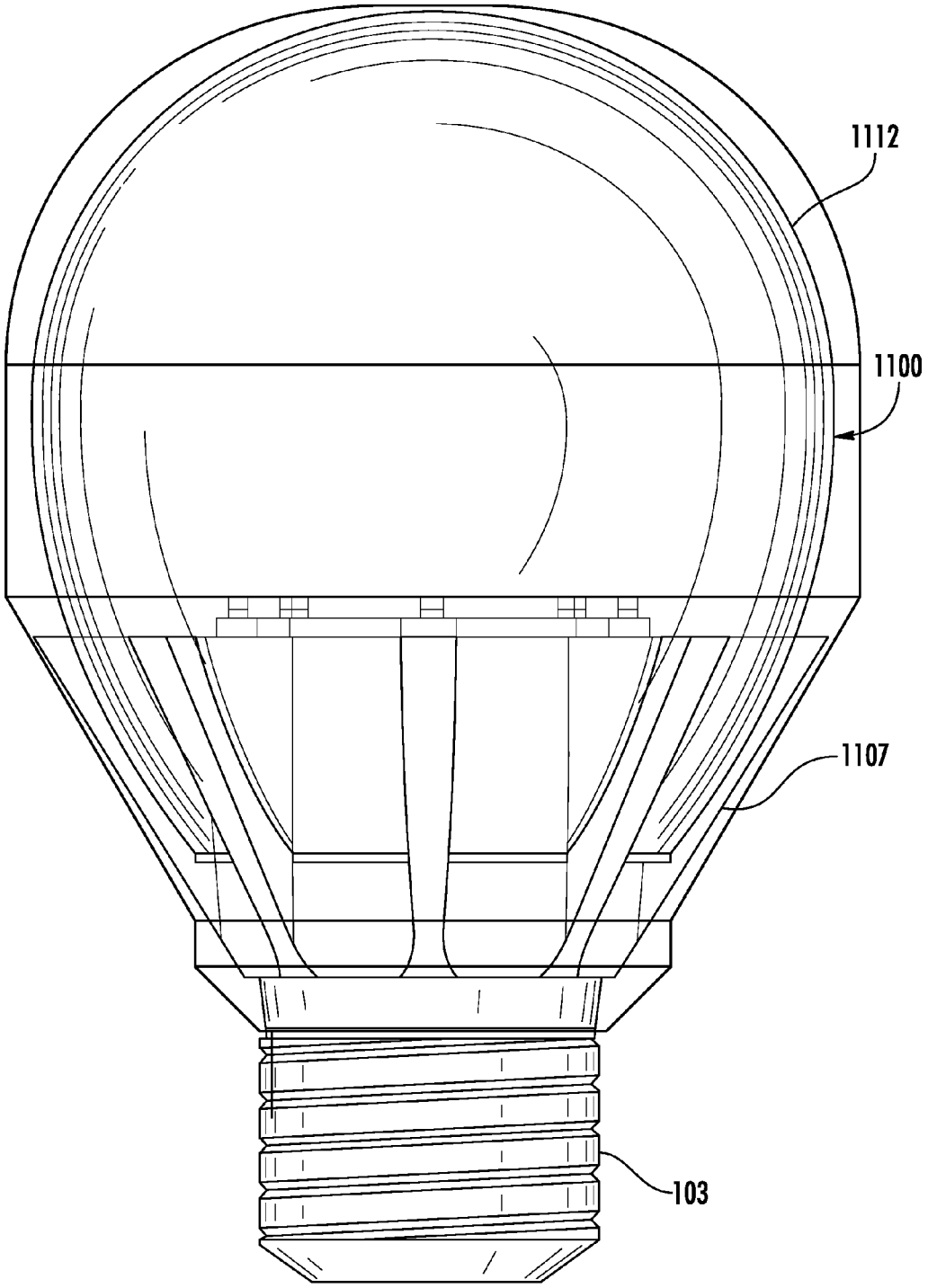
FIG. 17 is a plan view of another embodiment of a lamp of the invention in an A19 standard envelope.
Figure 20:
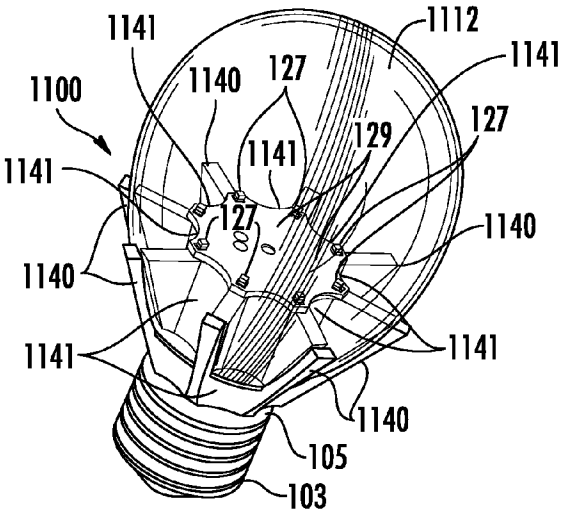
FIG. 20 is a perspective view of the lamp of FIG. 17.
Figure 18:
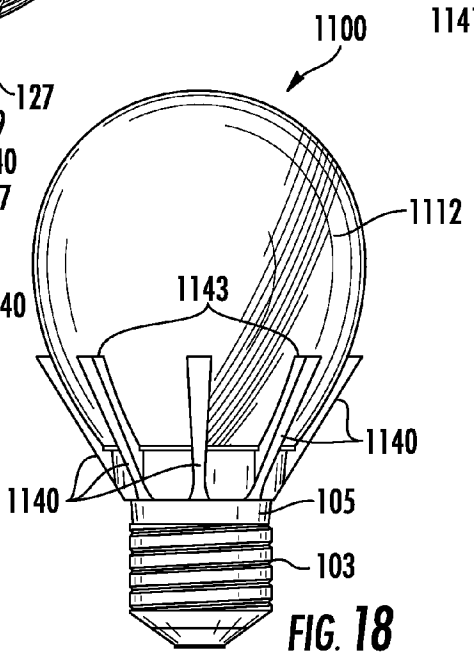
FIG. 18 is a plan view of the lamp of FIG. 17.
Figure 19:
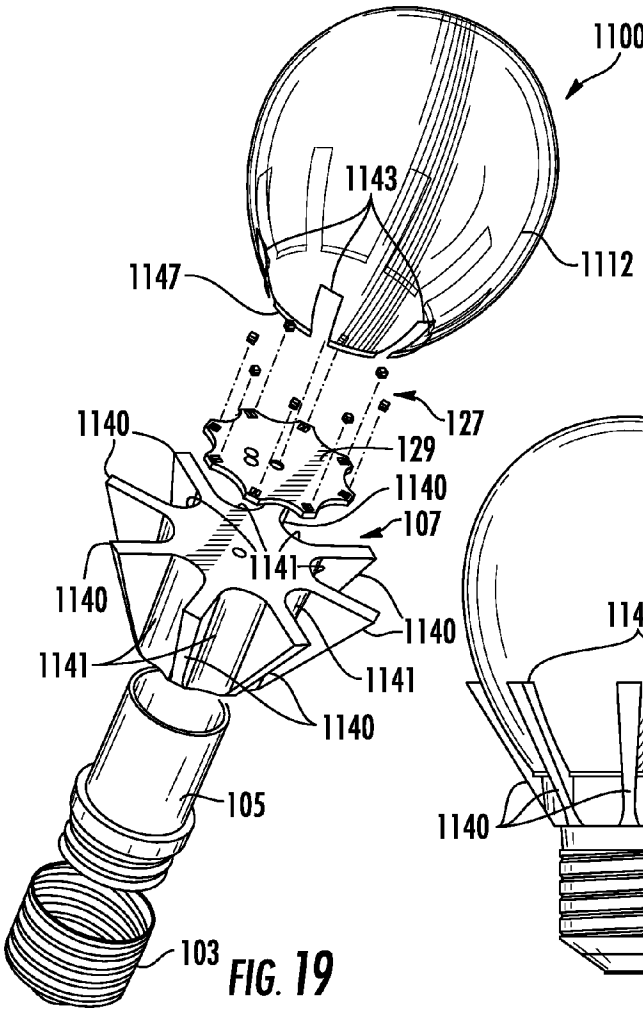
FIG. 19 is an exploded perspective views of a lamp of FIG. 17.

As shown in FIG. 16, the lamp 100 of FIG. 1 fits in the envelope for an A19 standard lamp. The A19 standard size is shown in solid black lines in FIG. 16. FIG. 17 is a similar view showing another embodiment of the lamp 1100 in the A19 standard envelope where the A19 standard is shown in solid black lines. The enclosure 1112 of the lamp in FIG. 17 has been increased in size as compared to the embodiment of FIG. 16 to fill the A19 standard envelope more completely. The lamp of FIG. 17 is also shown in FIGS. 18-20. One advantage of such an arrangement is to increase the size of the enclosure 1112 in order to increase the lumen output of the lamp and minimize optical losses. This is accomplished by spacing the enclosure 1112 farther from the LEDs 127 in the area below the LEDs. The end of the enclosure 1112 with opening 1147 extends farther down the heat sink 1107 than in the embodiment of FIG. 1. As a result, more of the backlight generated by the LEDs is able to pass through the enclosure without being internally reflected. In order to accommodate the larger enclosure 1112, the protruding portions 1140 of heat sink 1107 are extended further from the recessed portions 1141 such that when the enclosure 1112 is extended closer to the bottom of the heat sink 1107 the protruding portions 1140 extend through slots or apertures 1143 formed in the enclosure 1112 such that the protruding portions 1140 are exposed to the exterior of the lamp. In this manner the protruding portions 1140 may transfer heat to the ambient environment. A comparison of FIG. 1 and FIG. 18 shows that the enclosure 1112 in the embodiment of FIG. 18 covers a greater portion of the heat sink than the enclosure 112 of FIG. 1. As a result, the enclosure 1112 is spaced farther from the LEDs below the LEDs to allow backlight from the LEDs to more efficiently pass through the enclosure 1112 as downlight. A comparison of these figures also shows the protruding portions 1140 of the heat sink 107 extending through the enclosure 1112 to the exterior of the enclosure.

Figures 21, 22:
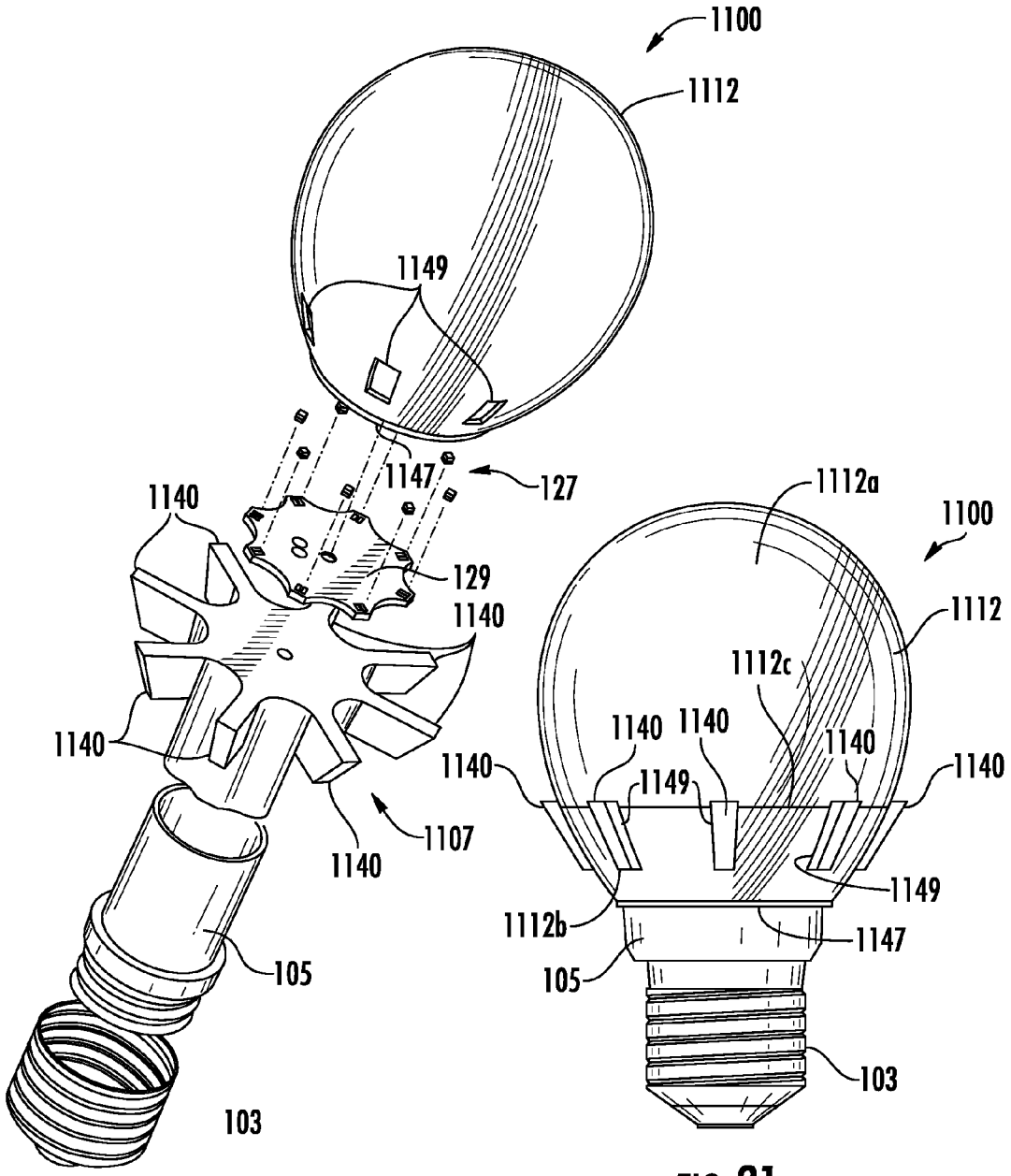
FIG. 21 is a plan view of another embodiment of the lamp of the invention.
FIG. 22 is an exploded perspective views of a lamp of FIG. 21.

In the embodiment of FIGS. 18-20 the heat sink 1107 comprises a central mounting area that is defined by the recessed portions 1141 and the mounting surface 1143 for substrate 129. The central mounting area is disposed generally centrally in the enclosure 1112 along the longitudinal axis A-A of the lamp (FIG. 21) and supports the substrate 129 and LEDs 127 in the center portion of enclosure 1112. The central mounting area is spaced from the enclosure such that it extends into the open space of the enclosure. The protruding portions 1140 extend from the central mounting portion through the interior open space of the enclosure 1112 to the exterior of the enclosure. In some embodiments the protruding portions 1140 extend through openings such as slots or apertures 1143 formed in the enclosure 1112. The slots 1143 may extend to the end 1147 of the enclosure as shown in FIGS. 18-20. Alternatively, the openings in the enclosure may be formed as apertures 1149 where the enclosure completely surrounds the protruding portions of the heat sink as shown in FIGS. 21 and 22. In the embodiment of FIGS. 21 and 22, the protruding portions 1140 may comprise separate components that are inserted through the apertures 1149 from the exterior of the enclosure and are thermally coupled to the central mounting area. Alternatively, the enclosure may be made of an upper portion 1112*a* and a lower portion 1112*b* that are secured together at seam 1112*c* to complete enclosure 1112 and that trap the portions 1140 in the apertures. The enclosure may be made of a suitable plastic. In other embodiments, the protruding portions 1140 may comprise relatively flexible or bendable members that are deformed to fit into the enclosure 1112 and expanded to extend through the apertures 1149. The enclosure 1112 and heat sink 1107 are arranged such that the enclosure 1112 extends over the heat sink 1107 where portions 1140 of the heat sink extend through the enclosure at a position between the open end of the enclosure 1147 and the distal end of the enclosure. The protruding portions may have different shapes, sizes, surface areas from that shown in the figures.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an optically transmissive enclosure;

a base connected to the enclosure defining a longitudinal axis of the lamp extending from the base to a distal end of the enclosure;

a substrate comprising a surface disposed substantially perpendicularly to the longitudinal axis supporting a plurality of LEDs in the enclosure positioned to direct light primarily away from base wherein the periphery of the substrate comprises alternating first recessed portions and first protruding portions that define a plurality of laterally extending projections where one of the plurality of LEDs is supported on one of the plurality of projections;

a heat sink comprising second protruding portions and second recessed portions that correspond to the first protruding portions and first recessed portions on the periphery of the substrate such that the second protruding portions are vertically aligned with the first protruding portions and the second recessed portions are vertically aligned with the first recessed portions such that a plurality of passages are formed along the longitudinal axis of the heat sink that extend from adjacent the LEDs toward the base, the heat sink having a first portion located inside of the enclosure and a second portion located outside of the enclosure where the plurality of passages extend from inside the enclosure to outside the enclosure.

2. The lamp of claim 1 wherein the base comprises an Edison connector.

3. The lamp of claim 1 wherein the substrate is thermally coupled to the heat sink such that heat from the LEDs is transferred to the exterior of the lamp.

4. The lamp of claim 1 wherein the plurality of LEDs are disposed about the periphery of the enclosure adjacent to the base.

5. The lamp of claim 1 wherein each one of the plurality of projections supports only a single one of the plurality of LEDs.

6. The lamp of claim 1 wherein the plurality of LEDs are mounted at the distal ends of the plurality of projections such that a portion of the light generated by the plurality of LEDs is projected as downlight toward the base of the lamp, the light projected as downlight being projected around a major portion of each of the plurality of LEDs.

7. The lamp of claim 1 wherein the projections are dimensioned such that the one of the plurality of LEDs is closely disposed to the edge of the one of the plurality of projections so that at least two sides of the one of the plurality of LEDs is closely disposed to two corresponding edges of the one of the plurality of projections and the profile of the first protruding portions is substantially the same as the profile of the second protruding portions.

8. The lamp of claim 1 wherein the enclosure extends over the substrate and the plurality of LEDs and is connected to the heat sink such that the second portion of the heat sink is disposed external to the enclosure between the enclosure and the base.

9. The lamp of claim 8 wherein an open neck of the enclosure closely conforms to the second protruding portions and the second recessed portions of the heat sink.

10. The lamp of claim 1 wherein the enclosure is provided with a plurality of tabs that extend into mating apertures on the heat sink.

11. The lamp of claim 1 wherein selected ones of the plurality of LEDs are mounted on the substrate such that the selected ones of the plurality of LEDs are disposed at an angle other than 90 degrees relative to a longitudinal axis of the lamp to direct more light as downlight.

12. The lamp of claim 11 wherein a mounting surface on the substrate for mounting the selected ones of the plurality of LEDs are disposed at an angle other than 90 degrees relative to the longitudinal axis of the lamp.

13. The lamp of claim 11 wherein the selected ones of the plurality of LEDs are mounted using a bendable substrate such that the projections are bent at an angle other than 90 degrees relative to the longitudinal axis to position the selected ones of the plurality of LEDs at the angle.

14. A lamp comprising:

an optically transmissive enclosure;

a base connected to the enclosure, the base and the enclosure defining a longitudinal axis of the lamp;

a substrate supporting a plurality of LEDs substantially perpendicular to the longitudinal axis in the enclosure wherein the periphery of the substrate comprises a plurality of laterally extending projections where one of the plurality of LEDs is supported on one of the plurality of projections such that a side of each of the plurality of projections is closely adjacent each of the plurality of LEDs such that each of the LEDs projects light over at least 180 degrees about the longitudinal axis of the lamp toward the base;

a heat sink disposed partially inside of the enclosure and partially outside of the enclosure comprising a plurality of protruding portions and a plurality of recessed portions; and a plurality of light passages formed by the plurality of projections on the substrate and the plurality of protruding portions and the plurality of recessed portions on the heat sink, the passages extending from inside of the enclosure to outside of the enclosure along the longitudinal axis.

15. The lamp of claim 14 wherein a portion of the heat sink extends through an aperture in the enclosure.

16. A lamp comprising:

an optically transmissive enclosure;

a base connected to the enclosure defining a longitudinal axis of the lamp extending from the base to a distal end of the enclosure;

a planar substrate disposed substantially perpendicularly to the longitudinal axis supporting a plurality of LEDs in the enclosure positioned to direct light primarily away from base wherein the periphery of the substrate comprises alternating first recessed portions and first protruding portions that define a plurality of laterally extending projections where one of the plurality of LEDs is supported on one of the plurality of projections such that a portion of the light from the LEDs is projected past the substrate as downlight;

a heat sink disposed partially inside of the enclosure and partially outside of the enclosure comprising second protruding portions and second recessed portions that correspond to the first protruding portions and first recessed portions on the periphery of the substrate such that the second protruding portions are vertically aligned with the first protruding portions and the second recessed portions are vertically aligned with the first recessed portions to form a plurality of light passages, the plurality of passages extending from inside of the enclosure to outside of the enclosure along the longitudinal axis.

17. A lamp comprising:

an optically transmissive enclosure;

a base connected to the enclosure defining a longitudinal axis of the lamp extending from the base to a distal end of the enclosure;

a substrate comprising a surface disposed substantially perpendicularly to the longitudinal axis supporting a plurality of LEDs in the enclosure positioned to direct light primarily away from base wherein the periphery of the substrate comprises alternating first recessed portions and first protruding portions that define a plurality of laterally extending projections where one of the plurality of LEDs is supported on one of the plurality of projections;

a heat sink comprising second protruding portions and second recessed portions that correspond to the first protruding portions and first recessed portions on the periphery of the substrate such that the second protruding portions are vertically aligned with the first protruding portions and the second recessed portions are vertically aligned with the first recessed portions such that a plurality of passages are formed along the longitudinal axis of the heat sink that extend from adjacent the LEDs toward the base wherein an open neck of the enclosure closely conforms to the second protruding portions and the second recessed portions of the heat sink and the enclosure extends over the substrate and the plurality of LEDs and is connected to the heat sink such that a portion of the heat sink is disposed external to the enclosure between the enclosure and the base.

18. A lamp comprising:

an optically transmissive enclosure;

a base connected to the enclosure defining a longitudinal axis of the lamp extending from the base to a distal end of the enclosure;

a substrate comprising a surface disposed substantially perpendicularly to the longitudinal axis supporting a plurality of LEDs in the enclosure positioned to direct light primarily away from base wherein the periphery of the substrate comprises alternating first recessed portions and first protruding portions that define a plurality of laterally extending projections where one of the plurality of LEDs is supported on one of the plurality of projections;

a heat sink comprising second protruding portions and second recessed portions that correspond to the first protruding portions and first recessed portions on the periphery of the substrate such that the second protruding portions are vertically aligned with the first protruding portions and the second recessed portions are vertically aligned with the first recessed portions such that a plurality of passages are formed along the longitudinal axis of the heat sink that extend from adjacent the LEDs toward the base wherein the protruding portions of the heat sink extend through the enclosure at a point spaced from an open neck of the enclosure.

* * * * *